US010070231B2

(12) United States Patent
Jensen et al.

(10) Patent No.: US 10,070,231 B2
(45) Date of Patent: Sep. 4, 2018

(54) HEARING DEVICE WITH INPUT TRANSDUCER AND WIRELESS RECEIVER

(71) Applicant: Oticon A/S, Smørum (DK)

(72) Inventors: Jesper Jensen, Smørum (DK); Jesper Bünsow Boldt, Måløv (DK)

(73) Assignee: Oticon A/S, Smørum (DK)

( * ) Notice: Subject to any disclaimer, the term of this patent is extended or adjusted under 35 U.S.C. 154(b) by 87 days.

(21) Appl. No.: 14/449,372

(22) Filed: Aug. 1, 2014

(65) Prior Publication Data

US 2015/0043742 A1 Feb. 12, 2015

(30) Foreign Application Priority Data

Aug. 9, 2013 (EP) ..... 13179844

(51) Int. Cl.
*H04R 25/00* (2006.01)

(52) U.S. Cl.
CPC ..... *H04R 25/554* (2013.01); *H04R 25/43* (2013.01); *H04R 2225/49* (2013.01)

(58) Field of Classification Search
None
See application file for complete search history.

(56) References Cited

U.S. PATENT DOCUMENTS

2009/0003637 A1* 1/2009 Pansell ..... H04R 25/55 381/314
2010/0104120 A1 4/2010 Steinbuss
2011/0142268 A1* 6/2011 Iwakuni ..... H04R 25/43 381/312
2012/0063610 A1* 3/2012 Kaulberg ..... H04R 25/407 381/71.1
2012/0221329 A1* 8/2012 Harsch ..... H04R 3/02 704/225

FOREIGN PATENT DOCUMENTS

DE 10 2011 075 739 A1 5/2012
EP 2 182 741 A1 5/2010

* cited by examiner

*Primary Examiner* — James Mooney
(74) *Attorney, Agent, or Firm* — Birch, Stewart, Kolasch & Birch, LLP

(57) ABSTRACT

The present disclosure regards a hearing device comprising a power source, electric circuitry, a loudspeaker, at least one microphone for sound from an acoustic environment, and at least one wireless receiver for wirelessly received sound signals. The microphone is configured to generate an environment sound signal. The wireless receiver is configured generate a source sound signal. The electric circuitry is configured to estimate at least one parameter of an impulse response from the location of the origin of the wirelessly received signal to the location of a user of the hearing device in dependence on the source sound signal and the environment sound signal. The electric circuitry is further configured to process the environment sound signal in dependence on the estimated at least one impulse-response parameter, thereby generating an output sound signal. The output sound signal is processed into sound by the loudspeaker.

17 Claims, 3 Drawing Sheets

HEARING DEVICE WITH INPUT TRANSDUCER AND WIRELESS RECEIVER

TECHNICAL FIELD

The disclosure regards a hearing device comprising an input transducer for receiving sound from an acoustic environment and a wireless receiver for wirelessly receiving sound signals.

BACKGROUND ART

Hearing devices generally comprise an input transducer, such as a microphone, a power source, electric circuitry and an output transducer, such as a loudspeaker. For certain acoustical environments a microphone to record direct sound may be insufficient to generate a suitable hearing experience for a hearing-device user, e.g., in a highly reverberant room like a church, a lecture hall, a concert hall or the like. Therefore hearing devices may include a wireless receiver for wirelessly receiving sound information, e.g., a telecoil or a wireless data receiver, such as a Bluetooth receiver, an infrared receiver, or the like. When using a telecoil or other wireless technology the undistorted target sound, e.g., a priest's voice in a church or a lecturer's voice in a lecture hall, is available directly in the hearing aid by wireless sound transmission. Unfortunately, directional cues will be absent and thus, the priest's voice sounds as if it was centred in the hearing-device user's head. Furthermore, since in this situation the hearing-device microphones are typically muted, the hearing-device user may also miss out on sounds from the nearby environment, e.g., the voice of a spouse or voices of other students sitting next to the hearing-device user (assuming that the voice levels are below the un-aided hearing threshold of the user). Even though the wireless technology thus allows a hearing-device user to understand the priest or the lecturer, the auditory experience is synthetic, lacks directional and room-related cues and does not at all resemble the normal hearing experience in a church, a lecture hall, a concert hall or the like.

US 2003/0223592 A1 discloses a microphone assembly comprising a transducer, a pre-amplifier, controllable switching means and an analog-to-digital (ND) converter. The transducer receives acoustic waves through a sound inlet port and converts the received acoustic waves to analog audio signals. The pre-amplifier has an input and an output terminal. The input terminal is connected to the transducer to receive analog signals from the transducer. The switching means have one or more input terminals, of which one or more terminals are connected to the output terminal of the pre-amplifier to receive amplified analog audio signals from the pre-amplifier. The analog-to-digital converter has an input and an input/output terminal, with the input terminal being connected to the output terminal of the switching means to convert received analog audio signals to digital audio signals. The microphone assembly may be connected to a telecoil unit. The switching means is adapted to select if either an analog signal from the microphone or if a signal from the telecoil unit is connected to the A/D converter to be converted to a digital signal.

EP 1 443 803 A2 discloses a hearing device comprising at least two analog input signal sources, at least one analog-to-digital converter, further processing means, input signal routing means, and signal detection means. The analog-to-digital converter generates a digital input signal from an analog input signal. The processing means digitally process the input signals. The input signal routing means selectively route each one of one or more selected input signals to the further processing means. The signal detection means are configured to analyse the analog input signals and to control the signal routing means according to results of the analysis.

In DE 43 27 901 C1 a device for supporting the hearing is disclosed with two microphones, each of them included in an ear housing and coupled to a control unit, and with at least one transmission unit. Each of the ear housings is adapted to be mounted in an area of a human ear and includes a transmitter, which is adapted to communicate with a receiver in the area of the control unit. The control unit is separated in space from the two microphones. The control unit receives input signals from the microphones. A comparison unit for evaluation of the input signals of the microphones is arranged in proximity to the control unit. The comparison unit modifies the output power of the control unit for a three dimensional sound replay. The control unit transmits at least one output signal to the at least one transmission unit. At least one transmission unit is arranged in the area of one of the ear housings. The comparison unit may comprise a time correlator.

WO 2011/027004 A2 discloses a method for operating a hearing device that is capable of receiving a plurality of input signals. A first step of the method is to extract source identification information embedded in the input signals. The source identification information identifies a signal source from which the input signal originates. A second step of the method is to extract audio type information embedded in the input signals. The audio type information provides an indication of the type of audio content present in the input signal. A third step of the method is to select input signals from the plurality of input signals for processing. The step of selecting is at least partly dependent on the extracted source identification information and/or the extracted audio type information. A fourth step is the processing of the selected signals. The step of processing is at least partly dependent on the extracted source identification information and/or the extracted audio type information. A fifth step is to generate an output signal of the hearing device by the processing of the selected signals. The method may comprise a step of processing in which a weighted sum of one or more modified signals is formed with the weighting being at least partly dependent on at least one of the extracted source identification information, the extracted audio type information and a sound class. A hearing device comprising means to perform the method is also disclosed.

EP 2 182 741 A1 discloses a hearing device with a microphone unit, a receiver unit, a classification unit and a signal processing unit. The microphone unit is adapted to record a sound signal and the receiver unit is adapted to record an electric or electromagnetic signal. The classification unit is adapted to determine an acoustic situation from the signals recorded by the microphone unit and the receiver unit. The signal processing unit is adapted to process the signals of the microphone unit and the receiver unit in dependence of an output signal of the classification unit. A time delay for an audio signal may be preconfigured in the signal processing unit.

DE 101 46 886 A1 discloses a hearing device with an acoustic signal input, an induction signal input, a control unit and a comparison unit. The acoustic signal input is adapted to receive an acoustic signal and the induction signal input is adapted to receive an induction signal. The comparison unit is adapted for comparing the received acoustic signal with the received induction signal and to deliver a comparison result to the control unit. The control unit is adapted to control the hearing device in dependence of the comparison result. In a method to control the hearing device a control step may comprise the decision of the acoustic signal and/or the induction signal to be the input signal for the hearing device. The acoustic signal and the induction signal may be mixed in the hearing device.

DISCLOSURE OF DISCLOSURE

It is an object of the disclosure to provide an improved hearing device with at least one input transducer and at least one wireless sound receiver as well as an improved method for using such a hearing device.

These and other objects of the disclosure are achieved by the disclosure defined in the accompanying independent claims and as explained in the following description. Further objects of the disclosure are achieved by the embodiments defined in the dependent claims and in the detailed description of the disclosure.

In the present context, the terms "wireless" and "wirelessly" refer to properties or modalities of entities, such as signals, apparatus and/or methods, for transmitting and/or receiving sound, and these terms are meant to include transmitting and/or receiving sound in an electric or electromagnetic form, as respectively an electric or an electromagnetic signal, and to exclude receiving acoustic sound directly by means of acoustic transducers.

In the present context, a "hearing device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

A hearing device may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. A hearing device may comprise a single unit or several units communicating electronically with each other.

More generally, a hearing device comprises an input transducer for receiving an acoustic signal from a user's surroundings and providing a corresponding input audio signal, a signal processing circuit for processing the input audio signal and an output means for providing an audible signal to the user in dependence on the processed audio signal. Some hearing devices may comprise multiple input transducers, e.g. for providing direction-dependent audio signal processing. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal in the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves and/or to the auditory cortex.

A "hearing system" refers to a system comprising one or two hearing devices, and a "binaural hearing system" refers to a system comprising one or two hearing devices and being adapted to cooperatively provide audible signals to both of the user's ears. Hearing systems or binaural hearing systems may further comprise "auxiliary devices", which communicate with the hearing devices and affect and/or benefit from the function of the hearing devices. Auxiliary devices may be e.g. remote controls, remote microphones, audio gateway devices, mobile phones, public-address systems, car audio systems or music players. Hearing devices, hearing systems or binaural hearing systems may e.g. be used for compensating for a hearing-impaired person's loss of hearing capability and/or augmenting or protecting a normal-hearing person's hearing capability.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The present disclosure will be more fully understood from the following detailed description of embodiments thereof, taken together with the drawings in which.

The figures are schematic and simplified for clarity, and they just show details, which are essential to the understanding of the disclosure, while other details are left out. Throughout, like reference numerals and/or names are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the scope of the disclosure will become apparent to those skilled in the art from this detailed description.

MODE(S) FOR CARRYING OUT THE DISCLOSURE

Figure 1:
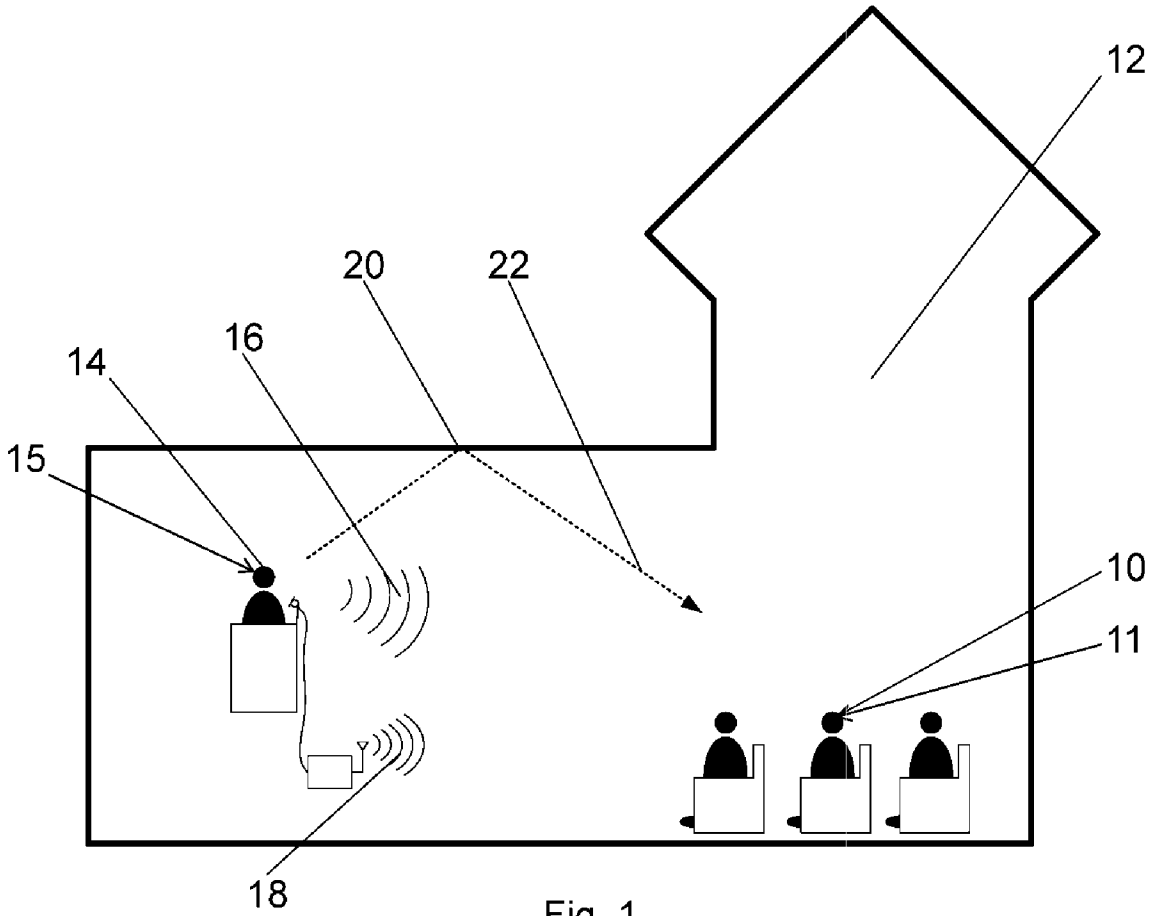
FIG. 1 shows a hearing device in a highly reverberant room.

FIG. 1 shows a hearing device 10 at a hearing-device user location 11 in a highly reverberant room 12. A sound source, in this example the voice of a priest 14, located at a sound source location 15 generates a sound wave. A portion of the sound wave, the direct sound 16, reaches the hearing device 10 without reflections. Another portion of the sound wave is received, preferably also without reflections, by an external microphone close to the sound source and converted into a wireless sound signal 18 that is transmitted wirelessly into the room 12. Further portions of the sound wave are reflected off the walls 20 of the room 12, and the reflected sound 22 arrives at various locations in the room 12 with different time delays with respect to the direct sound 16, and thereby appears as multiple echoes or reverberations. Reflected sound 22 may in turn be reflected off other surfaces of the room 12, and sound that has been reflected on many surfaces and therefore arrives with a large time delay and from many directions are typically referred to as "late reverberations" or "diffuse reverberations" as opposed to "early reverberations" which typically refers to sound that has been reflected only once and therefore arrives with a small time delay and from only a few distinct directions.

At the hearing-device user location 11, the direct sound 16 and the reflected sound 22 are received by a microphone 24 (see FIG. 2) of the hearing device 10. The wireless sound signal 18 is received by a wireless receiver 44 (see FIG. 3) of the hearing device 10, e.g. via a telecoil 26 (see FIG. 2). Since the external microphone is located close to the mouth of the priest 14, the direct sound 16 comprised in the wireless sound signal 18 is much louder than any reflected sound 22 therein, and the wireless sound signal 18 is thus characterised as noiseless. At the hearing-device user location 11, however, the late reverberations in the reflected sound 22 may be much louder than the direct sound 16 and may thus lead to a reduced sound quality of the sound received by the microphone 24 of the hearing device 10. In addition to the reverberations 22, other sounds from the environment may be received by the microphone 24, and the output signal from the microphone 24 is thus characterised as noisy.

Figure 2:
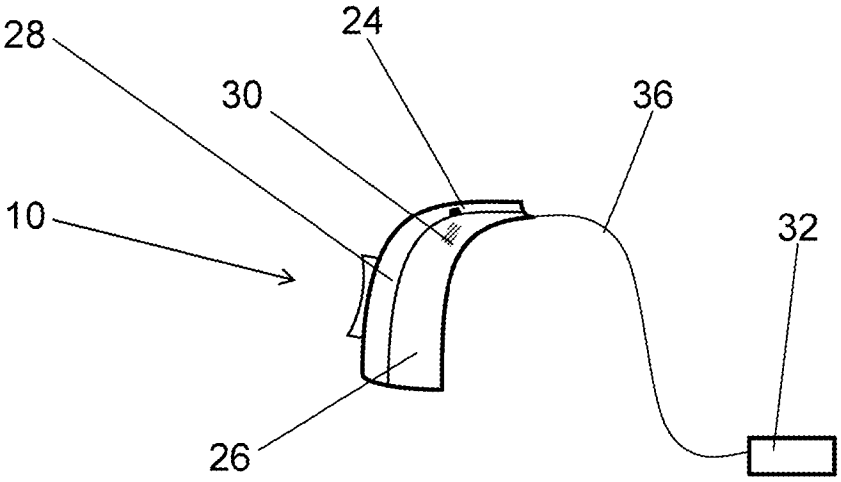
FIG. 2 shows an embodiment of a hearing device according to the disclosure.

FIG. 2 shows an embodiment of a hearing device 10 according to the disclosure, comprising a power source 28, a microphone 24, electric circuitry 30, a loudspeaker 32 and a telecoil 26. The microphone 24 receives direct sound 16, reflected sound 22 and sounds from the environment and generates an environment sound signal 34 (see FIG. 3). A wireless receiver 44 (see FIG. 3) receives the wireless sound signal 18 via the telecoil 26 and provides the received signal to a time delay unit 50, which delays the received signal in order to provide a source sound signal 19 corresponding to the wireless sound signal 18, however delayed to achieve a temporal alignment with the environment sound signal 34. The time delay unit 50 is controlled via a time delay signal 52 from the pre-processing unit 40. Similarly, the electric circuitry 30 may comprise a further time delay unit (not shown) to delay the environment sound signal 34 if required. In some embodiments, the time delay unit may 50 be omitted.

Figure 3:
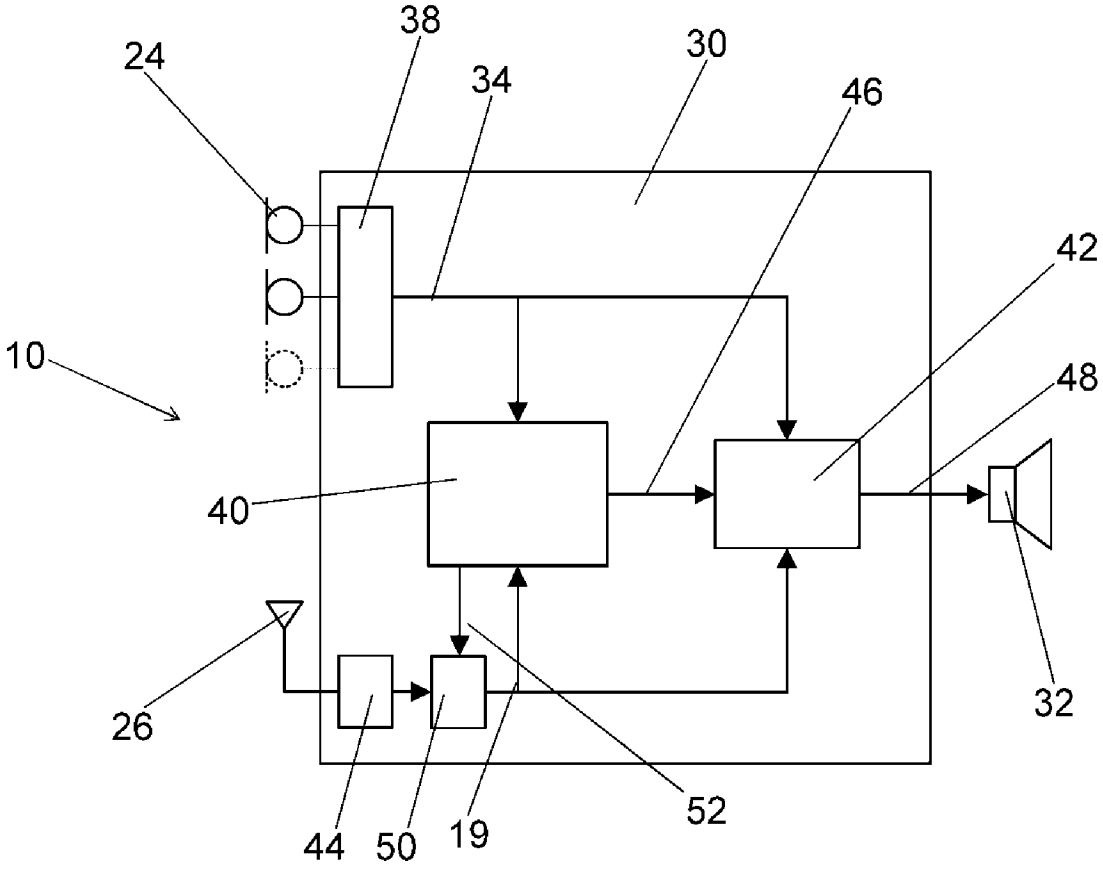
FIG. 3 shows a block diagram of the hearing device of FIG. 2.

Both sound signals 34, 19 are processed in the electric circuitry 30, which generates an output sound signal 48 (see FIG. 3). The output sound signal 48 is transmitted by a wired connection in a thin tube 36 from the electric circuitry 30 to the loudspeaker 32, where the output sound signal 48 is transformed into sound. The loudspeaker 32 may alternatively be arranged close to the microphone 24 and be connected to a thin acoustic tube, which is configured for insertion into an ear canal of a user (not shown). Many further hearing-device configurations are known in the art, such as e.g. so-called In-the-Ear (ITE) or Completely-In-the-Canal (CIC) hearing devices, and any known suitable hearing-device configuration may be used in embodiments of the present disclosure.

FIG. 3 shows a block diagram of the hearing device 10 shown in FIG. 2. Two or more microphones 24 receive direct sound 16, reflected sound 22 and sounds from the acoustic environment, from which the microphones 24 generate output signals, which are beamformed or otherwise spatially filtered in a beamformer or spatial filter 38 in the electric circuitry 30. The beamformer 38 generates an environment sound signal 34, e.g. as a linear combination of the output signals from the individual microphones 24.

The environment sound signal 34 is transmitted to a pre-processing unit 40 and to a sound signal processing unit 42. The wireless receiver 44 receives the wireless sound signals 18 via the telecoil 26 and converts it into a source sound signal 19. Alternatively the wireless receiver 44 may be e.g. a radio, a Bluetooth receiver, an infrared receiver, a wireless LAN receiver or another wireless signal or data receiver, in which cases, the telecoil 26 is preferably replaced by a corresponding antenna or optical detector. The source sound signal 19 is transmitted to the pre-processing unit 40 and to the sound signal processing unit 42.

The pre-processing unit 40 estimates at least one parameter of an impulse response of a sound path from the location 15 of the origin of the wirelessly received sound signal 18 to the location 11 of a user of the hearing device in dependence on the environment sound signal 34 and the source sound signal 19. The origin of the wirelessly received sound signal 18 is the location at which the acoustic signal comprised in the wirelessly received sound signal 18 is recorded, in this case the location of the external microphone, which is very close to the location 15 of the priest 14. The pre-processing unit 40 thus in principle estimates at least one parameter of an impulse response of the sound path from the location 15 of the sound source 14, however with a possible error due to a possible deviation between the location of the external microphone and the location of the sound source 14.

The at least one parameter may be estimated as e.g. a transfer function, a reverberation decay time, such as T60 which denotes the time it takes for the reverberation 22 to decay to a sound pressure level 60 dB below the sound pressure level of the direct sound 16, a ratio, such as the direct-to-reverberation-ratio DRR which denotes the ratio between the energy in the direct sound 16 and the total energy in the reverberated signal 22, and/or as an arbitrary combination of such parameters. The at least one parameter of the impulse response may be estimated by methods known in the art, such as e.g. recursive or non-recursive least square estimation, normalised or non-normalised least minimum square estimation, cross correlation, linear time-invariant theory (LTI system theory), or the like.

The electric circuitry 30 uses the estimated at least one impulse-response parameter to modify the contents of the output sound signal 48, such that late reverberations 22 are attenuated relative to the direct sound 16 and/or relative to early reverberations 22. This allows improving the quality and the intelligibility of the sound presented to the hearing-device user without degrading the user's awareness of the environment. In a church, for example, it allows the hearing-device user to hear and understand the priest while maintaining the sensation of being in a church around other people, i.e., to experience the room, people talking in the close surrounding, a door being opened, the organ playing, etc. The solution may even enable the hearing-device user to hear better than a normal-hearing person in highly reverberant environments.

The modification of the relative amounts of early and late reverberations 22 and/or direct sound 16 may be achieved in different ways as explained below.

In some embodiments, the pre-processing unit 40 uses the estimated at least one impulse-response parameter to identify signal portions of the environment sound signal 34 that mainly comprise late reverberations and to indicate such signal portions to the processing unit 42, which attenuates the indicated signal portions relative to other signal portions and/or amplifies or enhances other signal portions relative to the indicated signal portions. The indication may e.g. comprise a time-frequency representation of signal portions mainly comprising late reverberations, and the processing unit 42 may attenuate the indicated signal portions relative to other signal portions and/or amplify or enhance other signal portions relative to the indicated signal portions by manipulating the corresponding time-frequency segments of the environment sound signal 34 and/or of the output sound signal 48.

In some embodiments, the pre-processing unit 40 uses the estimated at least one impulse-response parameter to perform a complete or partial de-reverberation of the environment sound signal 34 that attenuates at least the late reverberations in the environment sound signal 34. Various techniques for such de-reverberation using knowledge of at least one parameter of the impulse response are well known in the art and any of these may be applied in the hearing device 10. Alternatively, or additionally, the pre-processing unit 40 may use the estimated at least one impulse-response parameter to apply an estimated impulse response to the source sound signal 19 in order to artificially add early reverberations thereto. The pre-processing unit 40 may provide the de-reverberated environment sound signal 34 and/or the artificially reverberated source sound signal 19 in a pre-processed sound signal 46 to the processing unit 42. The processing unit 42 may provide the output sound signal 48 as a linear combination of any of the environment sound signal 34, the source sound signal 19, the de-reverberated environment sound signal 46 and the artificially reverberated source sound signal 46. The signals 19, 34, 46 may be weighted using different weights.

In some embodiments, the pre-processing unit 40 may use the estimated at least one impulse-response parameter to classify a room type. Preferably the pre-processing unit 40 is configured to control further signal processing, such as e.g. noise reduction, signal compression and/or microphone directionality of the hearing device 10 according to a classified room type, e.g. by controlling corresponding parameters of the sound signal processing unit 42.

In some embodiments, the beamformer 38 may perform adaptive beamforming in dependence on the estimated at least one impulse-response parameter. The beamformer 38 may e.g. be controlled by the pre-processing unit 40, such that late reverberations 22 are attenuated relative to the direct sound 16 and/or relative to early reverberations 22 in the environment sound signal 34. The beamformer 38 may alternatively be absent, and the hearing device 10 may e.g. comprise only a single microphone 24, the output signal of which may serve as the environment sound signal 34.

In some embodiments, the sound signal processing unit 42 may add the signals into an output sound signal 48 comprising any of the pre-processed sound signal 46, the source sound signal 19 and the environment sound signal 34, or any mixture hereof. In some embodiments, the sound signal processing unit 42 performs further signal processing, such as e.g. noise reduction, signal compression and/or frequency-dependent amplification or attenuation, thereby modifying the pre-processed sound signal 46, the source sound signal 19, the environment sound signal 34 and/or the output signal 48, e.g. in order to compensate for the hearing-device user's hearing loss.

The wireless sound signal 18 may alternatively comprise only a portion of the sound received by the external microphone, such as e.g. one or more frequency sub-band signals or one or more sound components obtained by a suitable decomposition of the recorded sound. This may reduce the required signal bandwidth and/or the amount of data to be transmitted. The transmitted portion of the recorded sound should be selected such that the hearing device 10 is still able estimate the at least one impulse-response parameter.

The electric circuitry 30 may further comprise a control unit (not shown) connected to the pre-processing unit 40 and/or the sound signal processing unit 42 and configured to allow a user to control or influence the processing manually. The hearing device 10 may e.g. be configured to allow processing of the signals 19 and 34 to be controlled by a user, e.g. by allowing the user to switch between different acoustic environment modes and/or to adjust the weights used in combining the signals 19, 34, 46.

The hearing device 10 may further or alternatively be configured to adaptively control generation of the output signal 48, e.g. by controlling the weights used in combining the signals 19, 34, 46, in dependence on one or more of the signals 19, 34, 48. The weights may e.g. be controlled in dependence on the relative amounts of early and late reverberations in the environment sound signal 34 and/or in the output signal 48 in order to attempt to maintain a predefined ratio therebetween, or to attempt to keep the ratio within a predefined range.

The hearing device 10 shown in FIGS. 2 and 3 may be configured to perform the signal processing described above individually in each of a plurality of frequency sub-bands. To this end, the electronic circuit 30 may comprise an analysis filter bank (not shown) configured to decompose each of the received signals 19, 34 into a plurality of frequency sub-band signals, multiple pre-processing units 40 and sound signal processing units 42 configured to perform the signal processing described above individually on the frequency sub-band signals within each frequency sub-band—mutatis mutandi, and a synthesis filter bank (not shown) configured to synthesise the plurality of processed frequency-sub-band signals into a common output signal 48.

Preferably, the wirelessly received sound signal 18 is noiseless, meaning that it comprises only direct sound 16 from a single sound source 14 that the hearing-device user wants to listen to, or alternatively, that other sounds constitute only a minor portion of the wirelessly received sound signal 18. The environment sound signal may be noisy or noiseless. The environment sound may include direct sound 16, reverberation 22, i.e., early reflections and diffuse or late reflections, as well as other sounds from the environment. In some instances the amplitude of the direct sound 16 and/or the reverberations 22 may be too small to be recorded by the microphone 24, which in this case records only other sounds from the environment.

In some embodiments the pre-processing unit 40 may be configured to use the estimated at least one impulse-response parameter to pre-process the environment sound signal 34. In some embodiments the pre-processing unit 40 may be configured to reduce the signal amplitude of signal portions representing late reverberations in the environment sound signal 34. Late reverberations are sounds which have been reflected a large number of times, e.g., more than 5, more than 10, more than 100 or more than 1000 times. Generally, late reverberations arrive with a large time delay, such as e.g. 30 ms, 50 ms or 100 ms, after the direct sound 16 due to a high number of reflections before the sound is recorded in the microphone 24. Late reverberations are known to affect speech intelligibility negatively. Direct sound 16 is sound that is received by the microphone 24 from a sound source 14 without reflections. Early reverberations are sounds which were reflected only one or a few times and which have only a small time delay compared to the direct sound. Early reverberations may e.g. be defined as the signal portion arriving within 30 to 60 ms after the direct sound 16. Direct sound 16 and early reverberations 22 are considered to improve speech intelligibility. The early reverberations 22 in combination with the direct sound 16 may give the listener information about the size of a room 12 and the location of a sound source 14 in the room 12.

A reduction of the signal amplitude of signal portions representing late reverberations in the environment sound signal 34 and/or an enhancement of the signal amplitude of signal portions representing direct sound 16 and/or early reverberations may thus reduce the noise in the output sound signal 48, which may improve the sound quality and the intelligibility of the output sound of the hearing device 10.

Preferably, the time delay unit 50 applies the time delay to the wirelessly received signal 18, as transmission of a wireless signal 18 is generally faster than acoustic transmission of signals 16, 22.

The sound inlet for the microphone 24 is preferably arranged at a top side of the hearing device 10 when the hearing device 10 is mounted on an ear of a user. The hearing device 10 may include more than one sound inlet, more than one microphone 24 and/or more than one wireless receiver 44.

A hearing device 10 according to the disclosure may be used to perform a method for generating an output sound signal 48 from a noisy sound signal, e.g., the environment sound signal 34, and a noiseless sound signal, e.g., the wirelessly received sound signal 18.

A method for generating an output sound signal 48 from a noisy sound signal 34 and a noiseless sound signal 18 preferably comprises receiving a noisy sound signal 34 and a noiseless sound signal 18. The method may comprise temporally aligning the noisy sound signal 34 and the noiseless sound signal 18. The method may further comprise estimating at least one parameter of an impulse response from the location 15 of the origin of the noiseless sound signal 18, e.g., the location 15 of the priest 14, to the location 11 of the hearing-device user in dependence on the noisy sound signal 34 and the noiseless sound signal 18. Preferably the method comprises processing the noisy sound signal 34 and the noiseless sound signal 18, thereby generating an output sound signal 48 in dependence on the estimated at least one impulse-response parameter. The method may comprise processing the noisy sound signal 34 using the estimated at least one impulse-response parameter. The method may also comprise processing the noiseless sound signal 18 or both signals 34, 18 using the estimated at least one impulse-response parameter. The information in the noiseless sound signal 18 may be used to optimise the processing of the noisy sound signal 34, as a better estimate of a listening situation or environment parameters, such as room size, room type, or the like, may be obtained. The impulse response of the sound path from the location 15 of the origin of the noiseless sound signal 18 to the location 11 of the hearing-device user may be estimated with high precision in the hearing device 10, as both the noiseless sound signal 18 and the noisy sound signal 34 comprising reverberated sound 22 are available in the hearing device 10. Processing the noisy sound signal 34 may comprise reducing the signal amplitude of signal portions representing late reverberations 22 in the noisy sound signal 34 and/or enhancing the signal amplitude of signal portions representing direct sound 16 and/or early reverberations 22 in the noisy sound signal 34. This allows removal of unwanted or detrimental parts of the noisy sound 34 and/or enhancement of beneficial parts of the noisy sound 34. The method may further comprise mixing of the processed noisy sound signal 34 and the noiseless sound signal 18 into an output sound signal 48 by adding or mixing the sound signals. The mixing of the processed noisy sound signal 34 and the noiseless sound signal 18 may be performed as a weighted sum of the signals 34, 18, 46.

The sound quality may be enhanced by reducing the impact of the late reverberations, i.e. the "tail" of the impulse response. The method may further or alternatively comprise enhancing the signal amplitude of signal portions representing direct sound 16 and/or early reverberations 22 in the noisy sound signal 34. Direct sound 16 and the first few reflections 22 are known to affect sound intelligibility positively, therefore enhancing the signal amplitude of these signal portions may improve the sound quality. The estimated at least one impulse-response parameter may also be used to process the noisy sound signal 34; specifically the sound quality may be increased by enhancing the impact of the first part of the impulse response, i.e., enhancing direct sound 16 and first few reflections 22.

The output sound signal 48 may be processed into sound by a loudspeaker 32 of the hearing device 10. It is also possible to have two or more wireless receivers 44, receiving respective noiseless sound signals 18 originating at respective sound sources 14, which noiseless sound signals 18 may be processed by the hearing device 10 to determine at least one parameter of each of respective impulse responses of respective sound paths from the respective sound sources 14.

Embodiments of the method may comprises using the estimated at least one impulse-response parameter to perform at least partial de-reverberation of the environment sound signal 34 in order to remove or attenuate late reverberations 22.

In some embodiments of the method, the mixing of the noisy sound signal 34, the pre-processed sound signal 46 and/or the noiseless sound signal 18 is performed as a weighted sum of the signals 18, 34, 46. The method may comprise controlling one or more of the weights applied to the noisy sound signal 34, the pre-processed sound signal 46 and/or the noiseless sound signal 18. Preferably the weighted noisy sound signal 34, the weighted processed noisy sound signal 46 and/or the weighted noiseless sound signal 18 are mixed into an output sound signal 48 by temporary aligning and adding the sound signals 18, 34, 46. Also all three signals may be mixed, e.g., with the initial noisy sound signal 34 having a smaller weight than the other two signals 46, 18. The weights may be frequency-dependent, thus allowing e.g. different processing in different frequency bands.

The electric circuitry 30 is preferably implemented mainly as digital circuits operating in the discrete time domain, but any or all parts hereof may alternatively be implemented as analog circuits operating in the continuous time domain. Accordingly, A/D and D/A converters may be used to convert signals between analog and digital representation. Digital functional blocks of the electric circuitry 30 may be implemented in any suitable combination of hardware, firmware and software and/or in any suitable combination of hardware units. Furthermore, any single hardware unit may execute the operations of several functional blocks in parallel or in interleaved sequence and/or in any suitable combination thereof.

Some preferred embodiments have been described in the foregoing, but it should be stressed that the disclosure is not limited to these, but may be embodied in other ways within the subject-matter defined in the following claims. For example, the features of the described embodiments may be combined arbitrarily, e.g. in order to adapt the system, the devices and/or the method according to the disclosure to specific requirements.

It is further intended that the structural features of the system and/or devices described above, in the detailed description of 'mode(s) for carrying out the disclosure' and in the claims may be combined with the methods, when appropriately substituted by a corresponding process. Embodiments of the methods have the same advantages as the corresponding systems and/or devices.

Any reference numerals and names in the claims are intended to be non-limiting for their scope.

REFERENCE SIGNS

10 hearing device
11 hearing-device user location
12 highly reverberant room
14 priest
15 sound source location
16 direct sound
18 wireless sound signal
19 source sound signal
20 wall
22 reflected sound
24 microphone
26 telecoil
28 power source
30 electric circuitry
32 loudspeaker
34 environment sound signal
36 thin tube
38 beamformer
40 pre-processing unit
42 sound signal processing unit
44 wireless receiver
46 pre-processed sound signal
48 output sound signal
50 time delay unit
52 time delay signal

The invention claimed is:

1. A hearing device worn in or around a user's ear, the hearing aid comprising a power source, electric circuitry, an output transducer, an input transducer configured to receive sound from an acoustic environment and to generate a corresponding environment sound signal, and a wireless receiver configured to wirelessly receive a sound signal via an external microphone close to a sound source remote from the hearing device and to provide a corresponding wireless source sound signal which is substantially temporally-aligned with the environment sound signal, wherein the electric circuitry is configured to receive both the environment sound signal and wireless source sound signal, which are substantially temporally-aligned to one another, during use of the hearing device to estimate at least one parameter of an impulse-response of a sound path from a location of an origin of the wireless source sound signal to a location of the user of the hearing device in dependence of the wireless source sound signal and the environment sound signal, which are substantially temporally-aligned with one another, the electric circuitry is configured to process the environment sound signal in dependence of the at least one impulse-response parameter, which is estimated based on the substantially temporally-aligned wireless signal, thereby generating an output sound signal during use of the hearing device, wherein the electric circuitry is configured to use the estimated at least one impulse-response parameter to identify from the environment sound signal, which is substantially temporally-aligned to the wireless sound signal from which the at least one impulse-response parameter is estimated, signal portions that mainly comprise late reverberations and to indicate such signal portions, and the electric circuitry is configured to use the estimated at least one impulse-response parameter to modify the contents of the output sound signal, such that late reverberations in the identified signal portions are attenuated relative to direct sound and/or relative to early reverberations, and wherein the electric circuitry, which estimates the at least one impulse-response parameter and identifies the signal portions mainly comprising late reverberations, is entirely located within the hearing device worn in or around the user's ear.

2. The hearing device according to claim 1, wherein the electric circuitry is configured to reduce a signal amplitude of signal portions representing late reverberations in the output sound signal.

3. The hearing device according to claim 1, wherein the electric circuitry is configured to increase a signal amplitude of signal portions representing direct sound and/or early reverberations in the output sound signal.

4. The hearing device according to claim 1, wherein the electric circuitry is configured to perform at least partial de-reverberation of the environment sound signal in dependence on the estimated at least one impulse-response parameter.

5. The hearing device according to claim 1, wherein the electric circuitry comprises a time delay unit, which is configured to temporally align the source sound signal and the environment sound signal.

6. The hearing device according to claim 1, wherein the input transducer comprises a microphone.

7. The hearing device according to claim 1, wherein the wireless receiver comprises a telecoil.

8. The hearing device according to claim 1, wherein the hearing device is configured to allow a mixing of the source sound signal and the environment sound signal to be controlled by the user.

9. The hearing device according to claim 1, wherein the hearing device is configured to allow a mixing of the source sound signal and the environment sound signal to be controlled by an algorithm configured to be executed by the electric circuitry and wherein the algorithm is configured to adapt weighting of the source sound signal and the environment sound signal to a detected listening situation.

10. The hearing device according to claim 1, wherein the electric circuitry comprises a processing unit configured to enhance and/or reduce signal amplitudes of the identified signal portions of the environment sound signal.

11. A method for generating the output signal from the environment sound signal and the wireless sound signal using the hearing device according to claim 1, the method comprising:

receiving at the hearing device the environment sound signal and the wireless sound signal;

estimating, by the electric circuitry of the hearing device, the at least one parameter of an impulse-response of the sound path from the location of the origin of the wireless sound signal to the location of the user of the hearing device in dependence on the environment sound signal and the wireless sound signal; and generating, by the electric circuitry of the hearing device, the output sound signal in dependence on the environment sound signal and the estimated at least one impulse-response parameter comprising reducing the signal amplitude of signal portions representing reverberations in the output signal.

12. The method according to claim 11, wherein generating the output signal in dependence on the estimated at least one impulse-response parameter comprises increasing a signal amplitude of signal portions representing direct sound and/or early reverberations in the output signal.

13. The method according to claim 11, wherein generating the second output signal comprises mixing the noisy sound signal and the noiseless sound signal as a weighted sum of the noisy sound signal and the noiseless sound signal.

14. The hearing device according to claim 1, wherein said hearing device is a hearing aid.

15. The hearing device according to claim 14, wherein said electric circuitry is further configured to generate the output sound signal to compensate for hearing loss of the user.

16. The hearing device according to claim 14, wherein the hearing aid is configured for positioning the microphone behind an ear of the user.

17. The hearing device according to claim 16, wherein the hearing aid is configured for positioning the output transducer behind the ear of the user or in an ear canal of the user.

* * * * *